US009732278B2

(12) United States Patent
Kawachi et al.

(10) Patent No.: US 9,732,278 B2
(45) Date of Patent: Aug. 15, 2017

(54) PETROLEUM COKE AND PRODUCTION METHOD FOR SAME

(71) Applicant: JX Nippon Oil & Energy Corporation, Tokyo (JP)

(72) Inventors: Hiroshi Kawachi, Tokyo (JP); Kazuhisa Nakanishi, Tokyo (JP); Toshitaka Fujii, Tokyo (JP); Takashi Oyama, Tokyo (JP)

(73) Assignee: JX Nippon Oil & Energy Corporation (JP)

( * ) Notice: Subject to any disclaimer, the term of this patent is extended or adjusted under 35 U.S.C. 154(b) by 0 days.

(21) Appl. No.: 15/107,736

(22) PCT Filed: Dec. 19, 2014

(86) PCT No.: PCT/JP2014/083718

§ 371 (c)(1),
(2) Date: Jun. 23, 2016

(87) PCT Pub. No.: WO2015/098754

PCT Pub. Date: Jul. 2, 2015

(65) Prior Publication Data

US 2016/0319199 A1 Nov. 3, 2016

(30) Foreign Application Priority Data

Dec. 24, 2013 (JP) ..... 2013-265173

(51) Int. Cl.
*C10B 57/04* (2006.01)
*C10B 55/00* (2006.01)

(52) U.S. Cl.
CPC ..... *C10B 57/045* (2013.01); *C10B 55/00* (2013.01)

(58) Field of Classification Search
USPC ..... 44/627
See application file for complete search history.

(56) References Cited

U.S. PATENT DOCUMENTS

| | | | |
|---|---|---|---|
| 4,758,329 | A | 7/1988 | Newman et al. |
| 4,832,823 | A | 5/1989 | Goyal et al. |
| 4,894,144 | A | 1/1990 | Newman et al. |
| 5,059,301 | A | 10/1991 | Roussel et al. |
| 2009/0139899 | A1 | 6/2009 | Soares et al. |
| 2009/0237860 | A1 | 9/2009 | Oyama et al. |
| 2009/0268375 | A1 | 10/2009 | Oyama et al. |
| 2011/0253593 | A1 | 10/2011 | Oyama et al. |
| 2011/0267737 | A1 | 11/2011 | Oyama et al. |

FOREIGN PATENT DOCUMENTS

| | | | |
|---|---|---|---|
| EP | 1982956 | A1 | 10/2008 |
| JP | 04320489 | A | 11/1992 |
| JP | 2008150399 | A | 7/2008 |
| JP | 2008156376 | A | 7/2008 |
| JP | 2009544789 | A | 12/2009 |
| JP | 2012012488 | A | 1/2012 |
| WO | 2007074938 | A1 | 7/2007 |
| WO | 2007074939 | A1 | 7/2007 |
| WO | 2008012484 | A1 | 1/2008 |

OTHER PUBLICATIONS

International Search Report for Application No. PCT/JP2014/083718 dated Feb. 17, 2015.
International Preliminary Report on Patentability for Application No. PCT/JP2014/083718 dated Jul. 7, 2016.
European Patent Office Communication dated Nov. 24, 2016 in Appln. No. 14873777.8.

*Primary Examiner* — Randy Boyer
*Assistant Examiner* — Chantel Graham
(74) *Attorney, Agent, or Firm* — Lerner, David, Littenberg, Krumholz & Mentlik, LLP

(57) ABSTRACT

Provided are petroleum coke having a sufficiently small coefficient of thermal expansion (CTE) and yielding sufficiently suppressed puffing phenomenon and a method for stably producing the petroleum coke. Specifically, the method for producing the petroleum coke comprises the step of coking feedstock oil comprising light oil having an end point of distillation of 380° C. or less, and heavy oil having an initial boiling point of 200° C. or more and comprising 50% by mass or more of an aromatic component, sulfur content of 0.5% by mass or less, and nitrogen content of 0.2% by mass or less.

8 Claims, No Drawings

PETROLEUM COKE AND PRODUCTION METHOD FOR SAME

CROSS REFERENCE TO RELATED APPLICATIONS

The present application is a national phase entry under 35 U.S.C. §371 of International Application No. PCT/JP2014/083718, filed Dec. 19, 2014, published in Japanese, which claims the benefit of Japanese Patent Application No. 2013-265173, filed Dec. 24, 2013, the disclosures of which are incorporated by reference herein.

TECHNICAL FIELD

The present invention relates to petroleum coke and a production method therefor.

BACKGROUND ART

Needle coke is generally produced by using heavy oil such as petroleum heavy oil or coal tar as a raw material, and is used as an aggregate of a graphite electrode for electric steelmaking. In the process of producing a graphite electrode, needle coke having a predetermined grain size is first mixed with a binder pitch in a predetermined ratio, and then the obtained mixture is extrusion-molded, sintered, and graphitized.

The graphitization is performed by a heat treatment at about 3000° C., and a method using a direct-passage-of-electric-current type furnace (LWG furnace) is generally employed for the graphitization. In this method, since the temperature rises quickly, gas is generated at high speed due to an impurity such as sulfur or nitrogen contained in coke, so that irreversible expansion called "puffing" occurs. The occurrence of puffing leads not only to a decrease in electrode density but also to a fracture in the electrode.

In addition, since a graphite electrode is used under severe conditions such as a high-temperature atmosphere, a low coefficient of thermal expansion (CTE) is needed. That is, as the CTE decreases, electrode wear in the process of electric steelmaking decreases so that costs for electric steelmaking can be reduced. To reduce the CTE of a graphite electrode, the CTE of needle coke needs to be reduced.

Various methods for producing needle coke have been proposed for reducing puffing and CTEs in the needle coke. Patent Document 1 describes that bottom oil of a residue fluid catalytic cracking (RFCC) apparatus and vacuum residual oil are mixed, and then subjected to delayed coking. Patent Document 2 describes that first heavy oil obtained by hydrodesulfurization of heavy oil under a total pressure of 16 MPa or more and second heavy oil derived from a residue fluid catalytic cracking (RFCC) apparatus are mixed, and then subjected to delayed coking. Patent Document 3 describes that first heavy oil obtained as vacuum residual oil and second heavy oil derived from a residue fluid catalytic cracking (RFCC) apparatus are mixed, and then subjected to delayed coking.

REFERENCE DOCUMENT LIST

Patent Documents

Patent Document 1: Japanese Patent Application Laid-open Publication No. 2012-12488

Patent Document 2: Japanese Patent Application Laid-open Publication No. 2008-156376

Patent Document 3: Japanese Patent Application Laid-open Publication No. 2008-150399

SUMMARY OF THE INVENTION

Problems to be Solved by the Invention

Needle coke is produced in the following manner. A high-temperature treatment is performed on heavy oil so that cracking and polycondensation occur to generate liquid crystal spheres called "mesophases", and these liquid crystal spheres are combined to generate large liquid crystals called "bulk mesophases" as an intermediate. Through such process, the needle coke is produced. In general, to generate needle coke having a low CTE and low puffing, bottom oil of a fluid catalytic cracking apparatus, residual oil obtained by distilling low-sulfur crude oil under a reduced pressure, heavy oil obtained by performing advanced hydrodesulfurization on heavy oil with high sulfur content, or a mixture of at least two of these oils is used.

However, in the case of producing needle coke using only bottom oil of a fluid catalytic cracking apparatus (hereinafter also referred to as "fluid catalytic cracking residual oil"), excellent bulk mesophases are generated, but gas generation appropriate for carbonization and solidification does not occur. Consequently, a low CTE cannot be obtained. On the other hand, in the case of using residual oil obtained by distilling low-sulfur crude oil under a reduced pressure or heavy oil obtained by performing advanced hydrodesulfurization on heavy oil with high sulfur content (hereinafter referred to as "desulfurized residual oil"), gas generation appropriate for carbonization and solidification can be obtained, but excellent bulk mesophases cannot be formed. Consequently, a low CTE cannot be obtained, either.

In the case of mixing fluid catalytic cracking residual oil and desulfurized residual oil, unless sulfur content and nitrogen content in each of the fluid catalytic cracking residual oil and the desulfurized residual oil are small, low puffing cannot be obtained even though a low CTE can be obtained. On the other hand, since desulfurized residual oil is obtained by performing hydrodesulfurization on heavy oil with sulfur content of 2% by mass or more, the sulfur content after coking is larger than that of bottom oil obtained by fluid catalytic cracking (FCC).

In recent years, large amounts of petrochemical materials are needed in the oil industry, and it is required to obtain not gasoline but petrochemical materials including propylene as much as possible. A fluid catalytic cracking apparatus needs to perform a high cracking operation. Thus, obtained fluid catalytic cracking residual oil contains large sulfur content and large nitrogen content as highly cracked fluid catalytic cracking residual oil. In this case, needle coke capable of lowering puffing cannot be obtained in some cases.

The present invention has been made in view of the foregoing problems, and it has an object to provide petroleum coke having a sufficiently small coefficient of thermal expansion (CTE) and being capable of sufficiently suppressing puffing phenomenon, and to provide a petroleum coke producing method that can stably produce such petroleum coke.

Means for Solving the Problems

To solve the problems described above, the present invention provides a method for producing petroleum coke comprising the step of coking a feedstock oil comprising light oil and heavy oil, wherein the light oil has an end point of distillation of 380° C. or less, and the heavy oil has an initial boiling point of 200° C. or more and comprises 50% by mass or more of an aromatic component, sulfur content of 0.5% by mass or less, and nitrogen content of 0.2% by mass or less.

The present invention also provides petroleum coke obtained by the method for producing petroleum coke described above.

Effects of the Invention

According to the present invention, petroleum coke having a sufficiently small coefficient of thermal expansion and being capable of sufficiently suppressing puffing phenomenon can be produced with stability.

MODE FOR CARRYING OUT THE INVENTION

The inventors of the present invention have focused on the fact that puffing is increased when residual oil is used for coking, because the residual oil has high sulfur content and produces coke with a low yield for coking, so that the sulfur component is concentrated at a high concentration in coke. The inventors have intensively studied to discover that light oil that will not be coked during a coking reaction of heavy oil plays the role of gas generated from residual oil to reduce sulfur content. Excellent bulk mesophases are formed by using heavy oil only, and a gas derived from light oil is used for appropriate gas generated during solidification. Thus, petroleum coke having a sufficiently small CTE and being capable of sufficiently suppressing puffing phenomenon can be obtained. Heavy oil and light oil used in the present invention will be described hereinafter.

The heavy oil to be used in the present invention has an initial boiling point of 200° C. or more, preferably 250° C. or more. The upper limit of the initial boiling point is preferably 300° C. If the initial boiling point is less than 200° C., the yield of coke might decrease. The initial boiling point can be measured based on a method defined in Japanese Industrial Standard (JIS) K 2254-6: 1998.

A content of an aromatic component in the heavy oil used in the present invention is 50% by mass or more, and preferably 70% by mass or more. The upper limit of the content of the aromatic component is preferably 90% by mass. This is because within the range described above, excellent bulk mesophases can be formed to promote progress of coking reaction.

The sulfur content in the heavy oil to be used in the present invention is 0.5% by mass or less, preferably 0.4% by mass or less, and more preferably 0.3% by mass or less. The lower limit of the sulfur content is preferably 0.1% by mass. This is because if the sulfur content exceeds 0.5% by mass, puffing of petroleum coke cannot be sufficiently suppressed. The sulfur content can be measured based on a method defined in JIS M 8813-Annex 2: 2006.

The nitrogen content of the heavy oil to be used in the present invention is 0.2% by mass or less, preferably 0.15% by mass or less, and more preferably 0.10% by mass or less. The lower limit of the nitrogen content is preferably 0.01% by mass. This is because if the nitrogen content exceeds 0.2% by mass, puffing of petroleum coke cannot be sufficiently suppressed. The nitrogen content can be measured based on a method defined in JIS M 8813-Annex 4: 2006.

In the present invention, two or more types of heavy oil may be used.

The type of the heavy oil used in the present invention is not specifically limited as long as the initial boiling point, the aromatic component, the sulfur content, and the nitrogen content of the heavy oil satisfy the requirements described above. The heavy oil can be obtained by, for example, fluid catalytic cracking. The heavy oil to be used in the present invention is preferably hydrocarbon oil having a density of 0.8 g/cm$^3$ or more at 15° C. The density can be measured based on a method defined in JIS K 2249-1: 2011. Examples of feedstock oil for such heavy oil include atmospheric distillation residual oil, vacuum distillation residual oil, shale oil, tar sand bitumen, Orinoco tar, coal liquid, and heavy oil obtained by performing hydrogenation refining of these oils. The feedstock oil for such heavy oil may additionally contain relatively light oil such as straight diesel oil, vacuum gas oil, desulfurized light oil, or desulfurized vacuum gas oil, preferably vacuum gas oil. The vacuum gas oil is more preferably desulfurized vacuum gas oil preferably having sulfur content of 500 ppm by mass or less and a density of 0.8/cm$^3$ or more at 15° C., which is obtained by performing reduced-pressure distillation on atmospheric distillation residual oil and directly desulfurizing the obtained vacuum gas oil.

The atmospheric distillation residual oil is one of fractions in distillation obtained by, for example, heating crude oil under an atmospheric pressure with an atmospheric distillation device to fractionize the crude oil based on boiling points of the fractions. The fractions include gas, LPG, a gasoline fraction, a kerosine fraction, a light oil fraction, and atmospheric distillation residual oil (long residuum) which is a fraction having the highest boiling point. The heating temperature can vary depending on, for example, the field from which the crude oil was originated, and is not specifically limited as long as the crude oil can be fractionated into the fractions described above. For example, the crude oil is heated to 320° C.

Vacuum distillation residual oil (VR) is bottom oil of reduced-pressure distillation equipment obtained by subjecting crude oil to an atmospheric distillation device to isolate long residuum from gas and light oil, and then subjecting the long residuum to the furnace having outlet temperature range of from 320 to 360° C. under a reduced pressure of 10 to 30 Torr, for example.

Conditions for fluid catalytic cracking are not specifically limited as long as the obtained heavy oil has an initial boiling point, aromatic component, sulfur content, and nitrogen content that satisfy the above-described requirements. For example, a reaction temperature is 480 to 560° C., a total pressure is 1 to 3 kg/cm$^2$ G, a ratio of a catalyst to oil (catalyst/oil) is 1 to 20, and a contact time is 1 to 10 seconds.

Examples of the catalyst to be used for the fluid catalytic cracking include a zeolite catalyst, a silica alumina catalyst, or one or more of these catalysts carrying a precious metal such as platinum.

The light oil to be used in the present invention is preferably light oil having high aromatic content. Such light oil is typified by, for example, coker gas oil. This is because such light oil has high aromaticity, and thus, is highly compatible with heavy oil. Light oil with enhanced compatibility can be uniformly dispersed in heavy oil so that gas generation occurs uniformly, thus easing development of acicularity of coke. Consequently, the CTE of coke can decreases.

The process for obtaining the light oil described above is not specifically limited. Examples of such a process include a delayed coking process, a visbreaking process, a Eureka process, an HSC process, and a fluid catalytic cracking process.

Operating conditions are not specifically limited, but for example, the heavy oil described above as a raw material is subjected to a coker pyrolysis plant, preferably at a reaction pressure of 0.8 MPa and a cracking temperature of 400 to 600° C.

The end point in distillation of the light oil to be used in the present invention is 380° C. or less and is preferably 350° C. or less. The lower limit of the end point in distillation of the light oil is preferably 310° C. If the end point exceeds 380° C., the content of coked fractions increases, resulting in an increase in the CTE of coke. The end point can be measured based on a method defined in JIS K 2254-4: 1998.

The content of the asphaltene component of the light oil to be used in the present invention is preferably less than 1% by mass, and is more preferably 0% by mass. Since the end point in distillation of the light oil is 380° C. or less, the light oil contains substantially no component to be coked. If the light oil contains a large amount of a component to be coked, this component adversely affects the CTE of coke and puffing so that the CTE of coke and puffing cannot be sufficiently reduced.

From the viewpoint of compatibility with the heavy oil, the content of the aromatic component of the light oil to be used in the present invention is preferably 40% by volume or more, and more preferably 50% by volume or more. The upper limit of the content of the aromatic component is preferably 70% by volume. The content of the aromatic component herein refers to a percentage by volume (% by volume) of all the aromatic component based on the total amount of the coker gas oil as measured according to Journal of The Japan Petroleum Institute, JPI-5S-49-97, "Hydrocarbon Type Test Methods—High Performance Liquid Chromatography Method," published by The Japan Petroleum Institute.

In the light oil to be used in the present invention, the content of an aromatic component having two or more aromatic rings is preferably 20% by volume or more and more preferably 45% by volume or more. This is because the presence of polycyclic aromatic rings, including two aromatic rings, can provide high compatibility with heavy oil.

In the present invention, two or more types of light oil may be used together.

The type of feedstock oil for the light oil to be used in the present invention is not specifically limited as long as the light oil having the end point satisfying the above-described requirement can be formed by one of the processes described above. The feedstock oil preferably has a density of 0.8 g/cm$^3$ or more at 15° C.

Fluid catalytic cracking for obtaining the light oil is generally performed under the same conditions as those of fluid catalytic cracking for obtaining the heavy oil described above.

The temperature of the delayed coking process for obtaining the light oil is preferably 400 to 600° C. and the pressure thereof is preferably 300 to 800 kPa. Such a temperature range enables the reaction to proceed mildly at temperatures (400° C. or more) where coking proceeds. The pressure is preferably as high as possible because the coke yield increases as the pressure increases. However, the pressure can vary among processes.

The aromatic component of the heavy oil described above can be measured by a TLC-FID method. In the TLC-FID method, a sample is separated by thin layer chromatography (TLC) into four components: a saturated component, an aromatic component, a resin component, and an asphaltene component; and then these components are detected by a flame ionization detector (FID) so that the percentage of the amount of each component to the total amount of all the components can be defined as the composition ratio of each component.

First, for example, 0.2 g±0.01 g of a sample is dissolved in 10 ml of toluene to prepare a sample solution. The lower end of silica gel thin-layer rod (chromarod) baked beforehand, which is at the position of 0.5 cm of a rod holder, is spotted with a 1 μl of the solution by using a microsyringe, followed by drying with a dryer or the like. Then, a set of ten microrods, each having the sample, is developed using a developing solvent. As the developing solvents, hexane in a first development chamber, hexane/toluene (20:80 by volume) in a second development chamber, and dichloromethane/methanol (95:5 by volume) in a third development chamber are used. The saturated component is eluted and developed in the first development chamber using hexane as the solvent. The aromatic component is eluted and developed in the second development chamber using hexane/toluene as the solvent after the first development. The chromarods after development are loaded in a measuring instrument (for example, "IATROSCAN MK-5," trade name; product of Dia-Iatron (currently Mitsubishi Kagaku Iatron, Inc.)) to measure the amount of each component. Amounts of all the components are added together to obtain the total amount of all the components.

The contents of the aromatic component and the asphaltene component in the light oil described above can be measured by a method similar to that for measuring the content of the aromatic component of the heavy oil.

A method for producing petroleum coke according to the present invention will be described.

At least the light oil and the heavy oil described above are mixed to produce feedstock oil, and the feedstock oil is coked. In this manner, petroleum coke having a sufficiently small CTE and being capable of sufficiently suppressing puffing phenomenon can be produced with stability.

The heavy oil and the light oil in the feedstock oil are preferably mixed in such a manner that the content of the light oil in the feedstock oil is 5 to 30% by mass. If the content of the light oil is less than 5% by mass, the advantage of reducing the CTE and puffing of coke may not be sufficiently obtained. If the content of the light oil exceeds 30% by mass, the coke yield of the feedstock oil greatly decreases so that the production yield of coke may decrease. From the viewpoint of decrease in the CTE of coke, the content of light oil in the feedstock oil is more preferably 10 to 30% by mass.

The feedstock oil may be coked by a delayed coking method. Specifically, a preferable method for producing needle coke, comprises the steps of subjecting feedstock oil to thermal cracking and polycondensation with a delayed coker under conditions in which a coking pressure is controlled to obtain a raw coke, and calcining the raw coke with, for example, a rotary kiln or a shaft kiln to obtain needle coke. As preferable operating conditions for the delayed coker, the pressure is 300 to 800 kPa and the temperature is 400 to 600° C.

The calcination temperature is preferably 1000 to 1500° C. Since the raw coke contains a large amount of moisture and volatile components, calcination at a high temperature of 1000° C. or more can be performed to obtain calcined coke containing substantially no such components. If the calcination temperature exceeds 1500° C., the calcination may not be easily performed under constraints of temperature on equipment.

The sulfur content of the thus-obtained petroleum coke is preferably 0.3% by mass or less, and the coefficient of thermal expansion is preferably $1.5\times10^{-6}$/° C. or less, and more preferably $1.3\times10^{-6}$/° C. or less. The lower limit of the sulfur content is preferably 0.1% by mass. The lower limit of the coefficient of thermal expansion is preferably $1.0\times10^{-6}$/° C.

Since the obtained petroleum coke has low sulfur content and low nitrogen content, petroleum coke capable of suppressing the puffing to 0.2% or less can be obtained. To produce an excellent graphite electrode by using the petroleum coke described above, the coefficient of thermal expansion of the petroleum coke is preferably $1.5\times10^{-6}$/° C. or less, and more preferably $1.3\times10^{-6}$/° C. or less, and puffing is preferably 0.2% or less.

Examples of the method for producing a graphite electrode using petroleum coke according to the present invention comprises the steps of adding an appropriate amount of a binder pitch to the petroleum coke of the present invention to obtain a mixture, kneading the mixture with heat, extrusion-molding the kneaded mixture to form a green electrode, sintering (or carbonizing) the green electrode, graphitizing, and machining.

The steps for carbonization and graphitization are not specifically limited. In a generally employed step, the calcination (carbonization) is performed under an inert gas atmosphere of, for example, nitrogen, argon, or helium, at a maximum target temperature of 900 to 1500° C. with the maximum target temperature being maintained for 0 to 10 hours, and then the graphitization is performed under a similar inert gas atmosphere at a maximum target temperature of 2500 to 3200° C. with the maximum target temperature being maintained for 0 to 100 hours. After the carbonization, the green electrode is temporarily cooled and subjected to the heat treatment again for the graphitization.

As described above, according to the present invention, even in the case of using highly cracked fluid catalytic cracking residual oil prepared for a depressed gasoline demand, petroleum coke having a sufficiently small CTE and being capable of sufficiently suppressing puffing phenomenon can be obtained with stability. In the case of using conventional fluid catalytic cracking residual oil, petroleum coke having a sufficiently small CTE and being capable of further suppressing puffing can be obtained with stability.

EXAMPLES

The present invention will now be specifically described by examples, but the present invention is not limited to these examples.

Example 1

Desulfurized vacuum residual oil having sulfur content of 500 ppm by mass and a density of 0.88 g/cm$^3$ at 15° C. was subjected to fluid catalytic cracking to obtain fluid catalytic cracking residual oil (hereinafter referred to as "fluid catalytic cracking residual oil (A)"). The obtained fluid catalytic cracking residual oil (A) had an initial boiling point of 200° C., sulfur content of 0.2% by mass, nitrogen content of 0.1% by mass, and 65% by mass of an aromatic component.

Then, desulfurized vacuum residual oil having sulfur content of 500 ppm by mass and a density of 0.88 g/cm$^3$ at 15° C. was subjected to fluid catalytic cracking to obtain light cycle oil (hereinafter referred to as "fluid catalytic cracking light oil (A)"). The obtained fluid catalytic cracking light oil (A) had an initial boiling point of 180° C., an end point of distillation of 350° C., 0% by mass of an asphaltene component, 47% by volume of a saturated component, and 53% by volume of an aromatic component.

Atmospheric distillation residual oil having sulfur content of 3.5% by mass was subjected to hydrodesulfurization in the presence of a Ni—Mo catalyst for a hydrocracking percentage of 30% or less to obtain hydrodesulfurized oil (hereinafter referred to as "hydrodesulfurized oil (A)"). Desulfurized vacuum residual oil having sulfur content of 500 ppm by mass and a density of 0.88 g/cm$^3$ at 15° C. and hydrodesulfurized oil (A) having sulfur content of 0.3% by mass, nitrogen content of 0.1% by mass, 2% by mass of an asphaltene component, and 70% by mass of a saturated component, and a density of 0.92 g/cm$^3$ at 15° C. were mixed in a mass ratio of 1:2 and subjected to fluid catalytic cracking to obtain fluid catalytic cracking residual oil (hereinafter referred to as "fluid catalytic cracking residual oil (B)"). The obtained fluid catalytic cracking residual oil (B) had an initial boiling point of 220° C., sulfur content of 0.5% by mass, nitrogen content of 0.1% by mass, and 79% by mass of an aromatic component.

Thereafter, feedstock oil was obtained by mixing the fluid catalytic cracking residual oil (A), the fluid catalytic cracking residual oil (B), and the fluid catalytic cracking light oil (A) in a mass ratio of 5:2:3. This feedstock oil was loaded on a test tube, and was subjected to a heat treatment at 500° C. for three hours under an atmospheric pressure, for coking. Subsequently, the produced coke was calcined at 1000° C. for five hours to obtain calcined coke.

The calcinated coke was subjected to addition of 30% by mass of a carboniferous binder pitch, and then to an extruder to produce a cylindrical piece. This piece was calcined at 1000° C. for one hour in a muffle furnace, and then subjected to measurement of a coefficient of thermal expansion. Thereafter, the piece was subjected to a heat treatment of from room temperature to 2800° C. for measuring the degree of expansion therebetween as puffing.

To measure a coefficient of thermal expansion, a plurality of types of calcined cokes were pulverized into particle sizes of 1.4 mm or less as defined by JIS Z-8801 and mixed in a predetermined ratio, a binder pitch was added thereto in a predetermined ratio and the resulting mixture was kneaded and molded by an extruder to obtain an extrudate. The extrudate was calcined at 1000° C. to produce a piece for CTE measurement. An elongation of the piece in the longitudinal direction (from 200° C. to 300° C.) was measured to obtain a coefficient of thermal expansion.

With respect to puffing, calcined coke was pulverized to 425 μm or less, a binder pitch were added thereto in a predetermined ratio, and the resulting mixture was mixed and molded into a cylinder. The cylinder was calcined at 1000° C. to produce a piece for CLE measurement. An elongation of the piece in the longitudinal direction (from room temperature to 2800° C.) was measured to obtain a coefficient of linear expansion.

Example 2

Example 2 was performed in the same manner as Example 1 except that coker gas oil having sulfur content of 0.2% by mass, a density of 0.92 g/cm$^3$ at 15° C., 36% by volume of a saturated component, 64% by volume of an aromatic component, 0% by mass of an asphaltene component, an initial boiling point of 220° C. and an end point of distillation of 340° C., which was obtained by a delayed coking process and will be hereinafter referred to as "coker gas oil (A)", fluid catalytic cracking residual oil (A), and fluid catalytic cracking residual oil (B) were mixed in a mass ratio of 3:5:2, and used as feedstock oil.

Example 3

Example 3 was performed in the same manner as Example 1 except that fluid catalytic cracking residual oil (A), fluid catalytic cracking residual oil (B), hydrodesulfurized oil (A), and fluid catalytic cracking light oil (A) were mixed in a mass ratio of 5:2:1.5:1.5, and used as feedstock oil.

Example 4

Example 4 was performed in the same manner as Example 1 except that fluid catalytic cracking residual oil (A), fluid catalytic cracking residual oil (B), hydrodesulfurized oil (A), and coker gas oil (A) were mixed in a mass ratio of 5:2:1.5:1.5, and the mixture was used as feedstock oil.

Example 5

Example 5 was performed in the same manner as Example 1 except that desulfurized light oil having a density of 0.90 g/cm$^3$ at 15° C., 25% by volume of an aromatic component, 0% by mass of an asphaltene component, an initial boiling point of 180° C. and an end point of distillation of 350° C., which was obtained by using a light oil desulfurized device and will be hereinafter referred to as "desulfurized light oil (A)", fluid catalytic cracking residual oil (A), and fluid catalytic cracking residual oil (B) were mixed in a mass ratio of 3:5:2, and used as feedstock oil.

Example 6

Example 6 was performed in the same manner as Example 1 except that fluid catalytic cracking residual oil (A), fluid catalytic cracking residual oil (B), and coker gas oil (A) were mixed in a mass ratio of 7.5:2:0.5, and used as feedstock oil.

Comparative Example 1

Comparative Example 1 was performed in the same manner as Example 1 except that fluid catalytic cracking residual oil (A), fluid catalytic cracking residual oil (B), and hydrodesulfurized oil (A) were mixed in a mass ratio of 5.5:2:2.5, and used as feedstock oil.

Comparative Example 2

Comparative Example 2 was performed in the same manner as Example 1 except that hydrodesulfurized oil (A) was used as feedstock oil.

Comparative Example 3

Comparative Example 3 was performed in the same manner as Example 1 except that fluid catalytic cracking residual oil (A) was used as feedstock oil.

Comparative Example 4

Comparative Example 4 was performed in the same manner as Example 1 except that fluid catalytic cracking residual oil (B) was used as feedstock oil.

Table 1 shows sulfur content and nitrogen content in calcined coke obtained in Examples 1 to 6 and Comparative Examples 1 to 4. Table 1 also shows measurement results of coefficients of thermal expansion and puffing of the pieces obtained in Examples 1 to 6 and Comparative Examples 1 to 4. Table 2 shows properties of fluid catalytic cracking residual oil (A) and fluid catalytic cracking residual oil (B) as heavy oil. Table 3 shows properties of hydrodesulfurized oil (A), fluid catalytic cracking light oil (A), coker gas oil (A), and desulfurized light oil (A).

TABLE 1

| | Example 1 | Example 2 | Example 3 | Example 4 | Example 5 | Example 6 | Comparative Example 1 | Comparative Example 2 | Comparative Example 3 | Comparative Example 4 |
|---|---|---|---|---|---|---|---|---|---|---|
| Fluid catalytic cracking residual oil (A) (% by mass) | 50 | 50 | 50 | 50 | 50 | 75 | 55 | 0 | 100 | 0 |
| Fluid catalytic cracking residual oil (B) (% by mass) | 20 | 20 | 20 | 20 | 20 | 20 | 20 | 0 | 0 | 100 |
| Hydrodesulfurized oil (A) (% by mass) | 0 | 0 | 15 | 15 | 0 | 0 | 25 | 100 | 0 | 0 |
| Fluid catalytic cracking light oil (A) (% by mass) | 30 | 0 | 15 | 0 | 0 | 0 | 0 | 0 | 0 | 0 |
| Coker cracked light oil (A) (% by mass) | 0 | 30 | 0 | 15 | 0 | 5 | 0 | 0 | 0 | 0 |
| Desulfurized light oil (A) (% by mass) | 0 | 0 | 0 | 0 | 30 | 0 | 0 | 0 | 0 | 0 |
| Sulfur component (% by mass) | 0.2 | 0.2 | 0.3 | 0.3 | 0.2 | 0.3 | 0.4 | 0.9 | 0.1 | 0.5 |
| Nitrogen component (% by mass) | 0.1 | 0.1 | 0.1 | 0.1 | 0.1 | 0.1 | 0.1 | 0.3 | 0.1 | 0.2 |
| Coefficient of thermal expansion ($\times 10^{-6}$/° C.) | 1.3 | 1.3 | 1.3 | 1.3 | 1.5 | 1.5 | 1.3 | 2.0 | 1.8 | 1.8 |
| Puffing (%) | 0.1 | 0.1 | 0.2 | 0.2 | 0.1 | 0.2 | 0.3 | 0.8 | 0.1 | 0.5 |

TABLE 2

| | Fluid catalytic cracking residual oil (A) | Fluid catalytic cracking residual oil (B) |
|---|---|---|
| Initial boiling point (° C.) | 200 | 220 |
| Sulfur content (% by mass) | 0.2 | 0.5 |
| Nitrogen content (% by mass) | 0.1 | 0.1 |
| Saturated component (% by mass) | 33 | 17 |
| Aromatic component (% by mass) | 65 | 79 |
| Resin component (% by mass) | 2 | 4 |
| Asphaltene component (% by mass) | 0 | 0 |

TABLE 3

| | Hydro-desul-furized oil (A) | Fluid cata-lytic cracking light oil (A) | Coker cracked light oil (A) | Desul-furized light oil (A) |
|---|---|---|---|---|
| Density (15° C.) ($g/cm^3$) | 0.92 | 0.90 | 0.92 | 0.90 |
| Initial boiling point (° C.) | 300 | 180 | 220 | 180 |
| End point in distillation (° C.) | 500 or more | 350 | 340 | 350 |
| Sulfur content (% by mass) | 0.3 | 0.05 | 0.2 | less than 10 ppm |
| Nitrogen content (% by mass) | 0.1 | 0.01 | 0.05 | less than 5 ppm |
| Saturated component (% by mass) *1 | 70 | 47 | 36 | 75 |
| Aromatic component (% by mass) *1 | 23 | 53 (*2) | 64 (*3) | 25 |
| Resin component (% by mass) | 5 | 0 | 0 | 0 |
| Asphaltene component (% by mass) | 2 | 0 | 0 | 0 |

*1 A value in % means "% by volume" for light oil except hydrodesulfurized oil.
(*2) 24% of aromatic component having two or more aromatic rings.
(*3) 52% of aromatic component having two or more aromatic rings.

Table 1 shows that the sulfur content of each calcined coke obtained in Examples 1 to 6 was 0.3% by mass or less. Each piece obtained in Examples 1 to 6 had coefficient of thermal expansion of $1.5\times10^{-6}$/° C. or less, and puffing of 0.2% or less. Thus, the production method for petroleum coke according to the present invention is capable of sufficiently reducing a coefficient of thermal expansion and can sufficiently suppressing puffing.

The invention claimed is:

1. A method for producing needle coke, the method comprising the steps of:

coking a feedstock oil comprising light oil and heavy oil at 400 to 600° C. to obtain raw coke, wherein the light oil has an initial boiling point of 180° C. or more and an end point of distillation of 380° C. or less, and the heavy oil has an initial boiling point of 200° C. or more, and comprises 50% by mass or more of an aromatic component, sulfur content of 0.5% by mass or less, and nitrogen content of 0.2% by mass or less, and calcining the raw coke at 1000 to 1500° C. to obtain the needle coke having sulfur content of 0.3% by mass or less and a coefficient of thermal expansion of $1.5\times10^{-6}$/° C. or less.

2. The method according to claim 1, wherein the feedstock oil comprises 10 to 30% by mass of the light oil.

3. The method according to claim 1, wherein the light oil is derived from fluid catalytic cracking or delayed coking, and the heavy oil is obtained by fluid catalytic cracking.

4. Needle coke obtained by the method according to claim 1.

5. The method according to claim 2, wherein the light oil is derived from fluid catalytic cracking or delayed coking, and the heavy oil is obtained by fluid catalytic cracking.

6. The needle coke according to claim 4, wherein the feedstock oil comprises 10 to 30% by mass of the light oil.

7. The needle coke according to claim 4, wherein the light oil is derived from fluid catalytic cracking or delayed coking, and the heavy oil is obtained by fluid catalytic cracking.

8. The needle coke according to claim 6, wherein the light oil is derived from fluid catalytic cracking or delayed coking, and the heavy oil is obtained by fluid catalytic cracking.

* * * * *